United States Patent [19]

Giesen

[11] Patent Number: 5,011,017

[45] Date of Patent: Apr. 30, 1991

[54] FOLDED PAPER NAPKIN WITH UTENSIL POCKET

[75] Inventor: William E. Giesen, Appleton, Wis.

[73] Assignee: Wisconsin Tissue Mills Inc., Menasha, Wis.

[21] Appl. No.: 479,142

[22] Filed: Feb. 12, 1990

Related U.S. Application Data

[63] Continuation-in-part of Ser. No. 355,231, May 22, 1989, abandoned.

[51] Int. Cl.[5] ..... B65D 73/00

[52] U.S. Cl. ..... 206/494; 206/548; 206/553

[58] Field of Search ..... 206/553, 548, 594

[56] References Cited

U.S. PATENT DOCUMENTS

| | | | |
|---|---|---|---|
| 1,727,064 | 9/1929 | Joseph | 206/494 |
| 1,865,922 | 7/1932 | Kowalewski | 206/494 |
| 2,082,731 | 6/1937 | Broeren | 206/494 |
| 4,800,108 | 1/1989 | Swartz | 206/548 |

*Primary Examiner*—William I. Price

*Attorney, Agent, or Firm*—Quarles & Brady

[57] ABSTRACT

A paper napkin including a combination of crossing folds so as to form an exterior rectangular pocket for holding utensils that has a closed bottom, closed sides and an open top through which utensils can be inserted into the pocket.

4 Claims, 5 Drawing Sheets

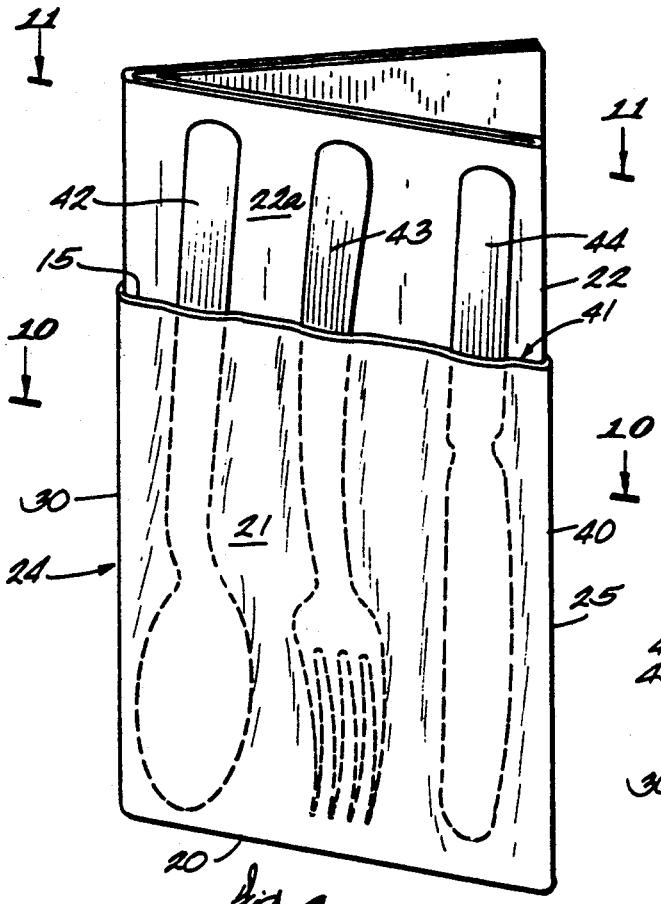
Fig. 9
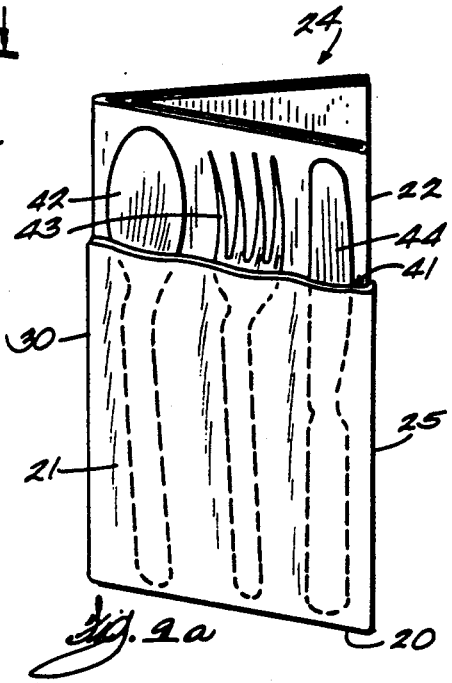
Fig. 9a
Fig. 10
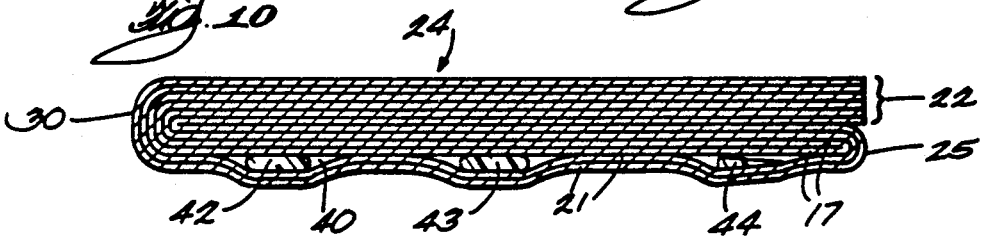
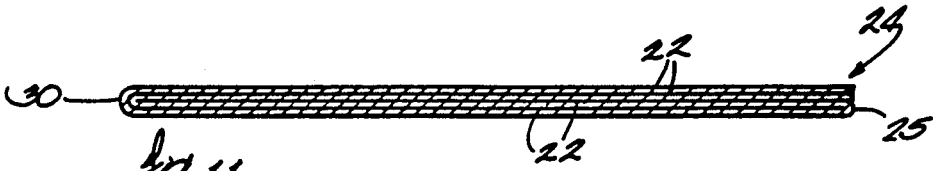
Fig. 11

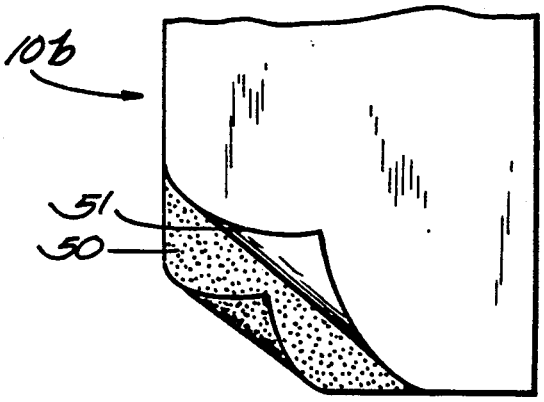
Fig. 18
Fig. 19
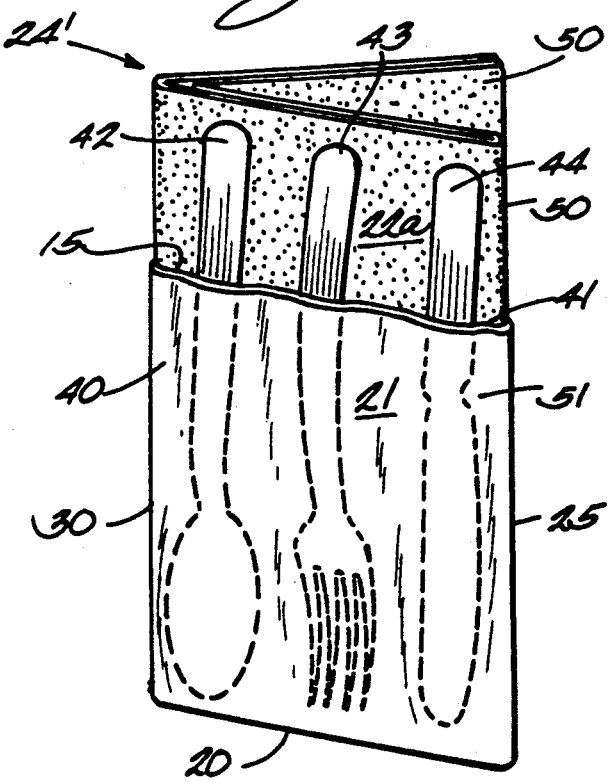

FOLDED PAPER NAPKIN WITH UTENSIL POCKET

CROSS REFERENCE TO RELATED APPLICATION

This application is a continuation-in-part of application Ser. No. 07/355,231 filed May 22, 1989 and now abandoned.

TECHNICAL FIELD

This invention relates to paper napkins that are folded to define a pocket in which utensils, such as a knife, fork and/or spoon, can be inserted, whereby a person can be provided with a napkin containing the appropriate eating utensils.

BACKGROUND ART

There are many instances in the food service industry in which it would be convenient for the operator to be able to package eating utensils together with a paper napkin. A paper napkin appropriately folded to hold eating utensils would allow the operator to insert utensils in the napkin prior to rush periods, eliminate the need for having boxes or containers of utensils accessible to diners, and provide an attractive presentation for the service of food. The customer would have the benefit of knowing that a minimum number of people have handled the utensils and there would be a reduced chance of the utensils sliding off a tray or a table. Fast food operations, hospital food service, cafeteria food service, and service of food on airplanes and other vehicle are examples of operations in which this would be advantageous to both the operator and the diner.

A paper napkin folded to include a pocket for holding utensils has been proposed as set forth in U.S. Pat. No. 1,865,922 issued on Jul. 5, 1932. The construction and folding procedures described in this patent include a combination of diagonal and right angle folds that yield a diamond or cornucopia shaped folded napkin having a triangular pocket in which utensils can be inserted. There are several problems associated with the constructions and methods described in this patent. The types of folds required by the construction of the patent can only be performed on individual napkins instead of on a web of tissue from which a napkin is made. The various diagonal folds taught by the patent cannot be made with commercial folding equipment at the high rates of speed necessary for economical production of paper napkins. Also, the triangular shape of the utensil pocket results in a rather small compartment for holding utensils and, as illustrated in the patent, parts of the utensils extend beyond the boundary of the napkin when inserted in the pocket so that the napkin provides limited protection for the utensils. It is therefore considered that the folded paper napkin as described in the patent is not suitable for commercial production at the high speeds presently required to produce paper napkins at a competitive cost.

The present invention was developed to provide a new construction of a paper napkin that is folded to include a compartment or pocket for holding eating utensils that is capable of meeting objectives such as (1) performing as many folds as possible while the tissue from which the paper napkin is made is in web form, (2) eliminating the need for diagonal folds, (3) providing a construction in which the pocket for holding the utensil is of maximum size, and (4) providing a folded napkin construction in which the napkin underlies the utensils stored in the pocket to thereby provide increased protection for the utensils. These and other features, objectives and advantages of the present invention will become apparent from the detailed description which follows.

SUMMARY OF THE INVENTION

My present invention provides a paper napkin wherein a pocket for holding eating utensils is defined by several folds, wherein a first fold is formed parallel to one edge of the napkin, an optional second fold may be formed parallel to the first fold, and a first perpendicular fold and a second perpendicular fold are formed that are perpendicular to the first fold and the second fold when used, whereby a rectangular shaped folded napkin is provided that has a pocket for the utensils. Further, my invention provides a method for producing a folded napkin of the foregoing type wherein the first fold, and second fold when used, can be made when the tissue material from which the paper napkin is made is in web form and the first and second perpendicular folds are made after an individual napkin has been severed from the folded web.

BRIEF DESCRIPTION OF THE DRAWINGS

The following enabling description sets forth presently-preferred embodiments of the product and method of this invention and is made by reference to the accompanying drawings in which:

FIGS. 4–8 illustrate the sequence of folds of the invention starting with a single napkin, in which:

FIG. 4 is a plan view of a single unfolded napkin;

FIG. 5 is a perspective view illustrating the first fold;

FIG. 6 is a perspective view illustrating the second fold;

FIG. 7 is a perspective view illustrating the first perpendicular fold;

FIG. 8 is a perspective view illustrating the second perpendicular fold;

FIG. 9 is a perspective view of a folded napkin of the type formed by the methods of FIGS. 1–3 and 4–8, with utensils inserted in the pocket of the folded napkin;

Figure 12:
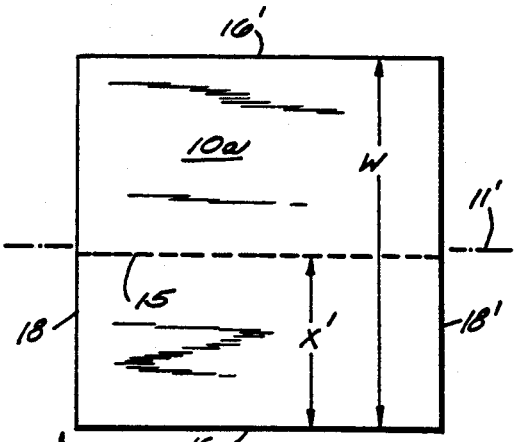
Figure 13:
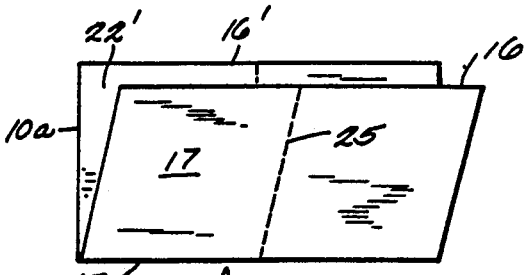
Figure 14:
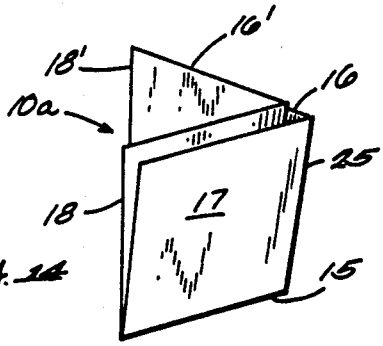
Figure 15:
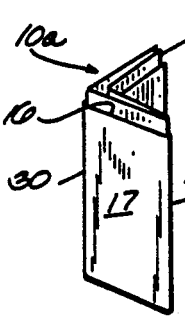
Figure 17:
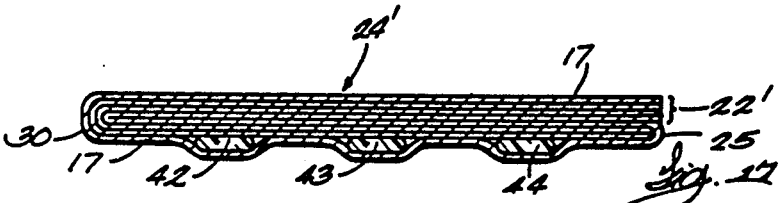
Figure 16:
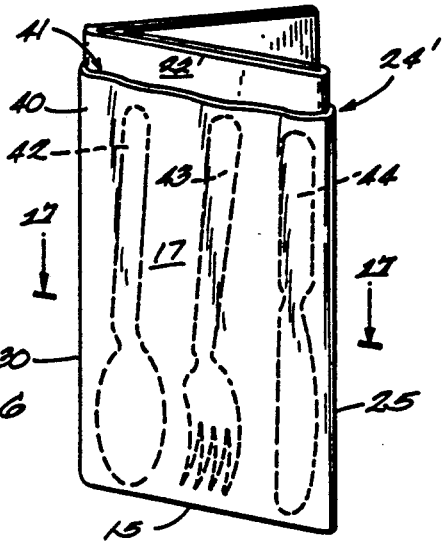

FIG. **9*a*** is a perspective view illustrating an alternate manner of inserting utensils in the pocket of a folded napkin of the invention;

FIG. 10 is a sectional view of the folded napkin of FIG. 9 along the plane of line 10—10 thereof;

FIG. 11 is a sectional view of the folded napkin of FIG. 9 along the plane of line 11—11 thereof; FIGS. 12–17 illustrate the sequence of folds of a second embodiment of the invention, in which:

FIG. 12 is a plan view of a single unfolded napkin;

FIG. 13 is a perspective view illustrating the first fold;

FIG. 14 is a perspective view illustrating the first perpendicular fold;

FIG. 15 is a perspective view illustrating the second perpendicular fold;

FIG. 16 is a perspective view of a folded napkin of the second embodiment with utensils inserted in the pocket of the napkin;

FIG. 17 is a sectional view of the folded napkin of FIG. 16 along the plane 17—17 thereof; and FIGS. 18 and 19 illustrate a third embodiment, in which:

FIG. 18 is a plan view of a portion of a web of tissue; and

FIG. 19 is a perspective view of a napkin folded from the web of FIG. 18.

DESCRIPTION OF PREFERRED EMBODIMENTS

Figures 1, 2, 3:
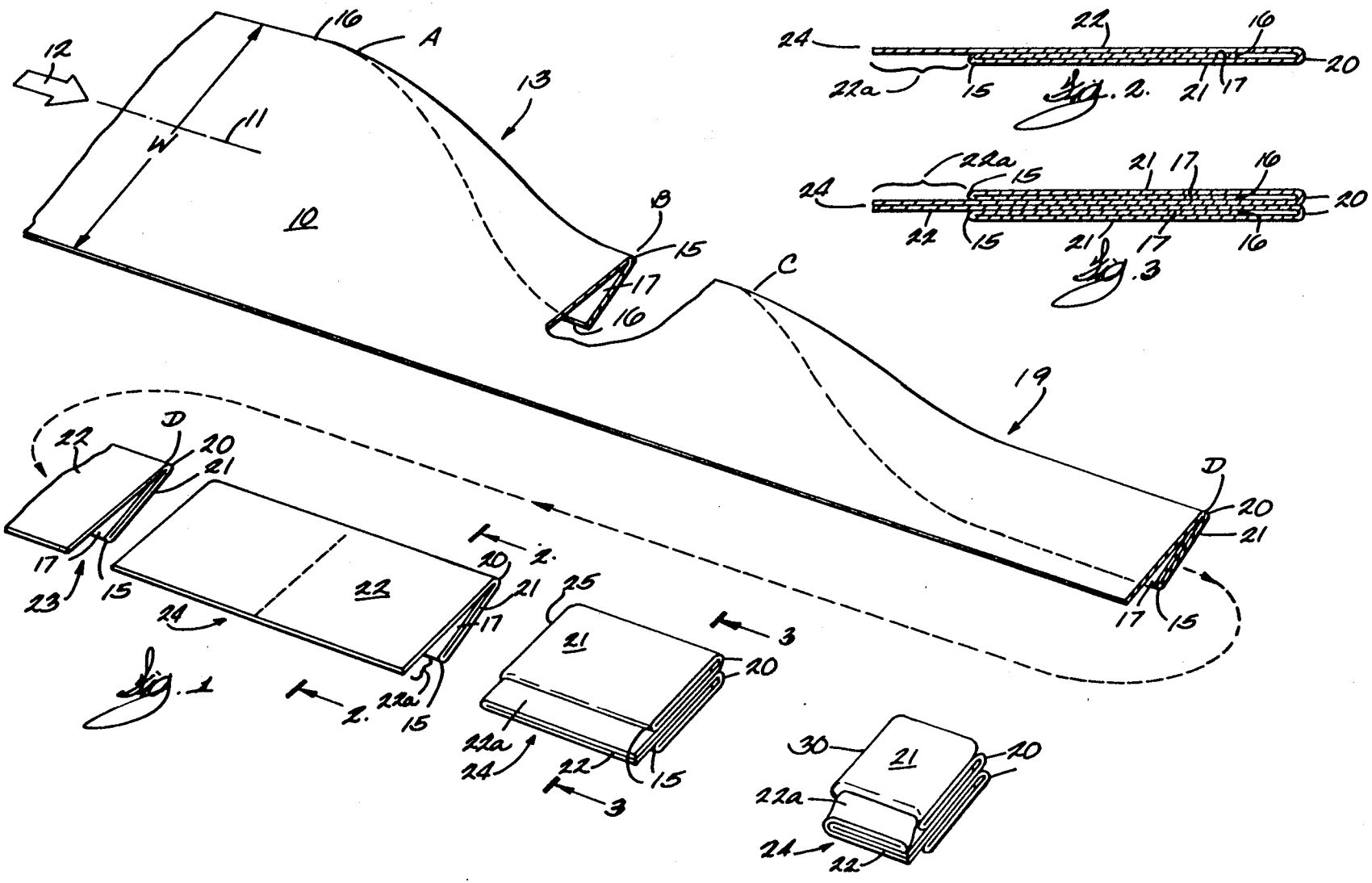
FIG. 1 is a schematic perspective view illustrating the sequence of folds involved in producing a folded napkin of the invention starting with a web of tissue.
FIG. 2 is a transverse sectional view along the plane of line 2—2 of FIG. 1.
FIG. 3 is a transverse sectional view along the plane of line 3—3 of FIG. 1.

FIG. 1 is a schematic representation of a series of steps involved in the manufactured of a folded napkin of this invention starting with a continuous web 10 of tissue suitable for paper napkins. Web 10 is unwound from a supply roll, not shown, and advanced along its longitudinal axis 11 in the direction indicated by arrow 12; any suitable web transport equipment of various types well known in the art can be used for this purpose. A paper napkin when unfolded may be a square or rectangular sheet of tissue, generally having sides in the range of about 16 inches to 22 inches long, although other sizes can be used. The width W of web 10 is cut to the size selected for a particular napkin. Web 10 may be a single ply or multiple ply tissue, as desired, and may have for example from one to four plies.

The web 10 is advanced through a first folding station indicated by the reference numeral 13 which comprises any suitable folding equipment known in the art, and first fold 15 is formed in web 10 that is parallel to a longitudinal edge 16 of the web; first fold 15 is also parallel to the longitudinal axis 11 of the web. Folding web 10 to form first fold 15 takes place as the web is continuously advanced and is depicted in FIG. 1 as commencing at point A and being completed at point B. First fold 15 is most usefully located a distance from longitudinal edge 16 of the web in the range of about 5% to 30% of the width W of web 10. For most sizes of paper napkins, first fold 15 can be in the range of about 1 to 4 inches from edge 16 of the web. The portion of web 10 broken away in FIG. 1 shows first panel 17 underlying the balance of web 10, after first fold 15 has been completed, which is the section of web 10 between first fold 15 and edge 16. Edge 16 of the web is now positioned under the balance of the web.

After the formation of the first fold, advancement of web 10 is continuous from station 13 to and through second folding station 19, at which station second fold 20 is formed in the web. Second fold 20 may be formed adjacent edge 16 of the web or spaced in the range of about ¼ to 6 inches from edge 16. Second fold 20 is parallel to both the first fold 15 and edge 16. Formation of second fold 20 is illustrated in FIG. 1 as starting at point C and finishing at point D, and results in second panel 21 of the web being superimposed on first panel 17 under the balance of web 10; panel 21 is the section of web 10 between folds 15 and 20. The sectional view of FIG. 2, shows web 10 after the second fold has been formed, which results in second panel 21 that extends over or is superimposed on first panel 17. Second panel 21 will form the front panel of a pocket as explained in detail below, and the transverse distance between first fold 15 and second fold 20 should be sufficient to provide a pocket of the desired depth, usually about 4 to 6 inches being suitable for most uses. The balance of the web 10 defines a third panel 22 after panels 17 and 21 have been defined by first fold 15 and second fold 20. Third panel 22 is to be longer, measured perpendicular to folds 15 and 20, than second panel 21 so as to have a section 22*a* that extends beyond first fold 15, for the reason described below.

After leaving second folding station 19, web 10 is advanced through cutting station 23 at which any suitable cutting tool is used to cut the web to form an individual napkin 24 which consists of a section of the web as previously folded. The cut to form an individual napkin is made perpendicular to longitudinal axis 11 of the web 10, and similar cuts are made across the web spaced from one another in the machine direction a distance equal to the length selected for the napkin, the cuts being made at intervals to define a plurality of napkins from the web.

After being cut from the web, napkin 24 is folded along its transverse center line to form first perpendicular fold 25 that is perpendicular to first fold 15 and second fold 20. Napkin 24 is shown in cross section in FIG. 3 after the first perpendicular fold has been formed in this manner. It may be seen that panel 22 of the napkin has been folded in half upon itself and that one-half of first panel 17 and one-half of second panel 21 are positioned along each exterior surface of folded third panel 22.

Next, napkin 24 in its condition after first perpendicular fold 25 has been formed, is folded in half again along second perpendicular fold 30 that is parallel to fold 25. This completes the folding steps required to produce a napkin of the invention, and napkin 24 at this stage will include a pocket that is closed along its two side edges and bottom edge and has an open top through which utensils can be inserted into the pocket. The final structure of the folded napkin will be described in greater detail hereinafter in reference to FIGS. 9–11.

It should be noted that the method described above normally is carried out as an inline process. Arrow 12 is shown as curved in FIG. 1 since the drawing had to be divided into two sections because of space limitations; in actual production, web 10 and napkins 24 cut from the web are advanced in a straight line.

FIGS. 4–8 illustrate the manner in which the four folds described above would be formed in a sheet 10*a* of tissue to produce a folded napkin of the invention. The same reference numerals used in the foregoing description made in reference to FIGS. 1–3 are used in the following description to identify the same or similar elements.

Figure 4:
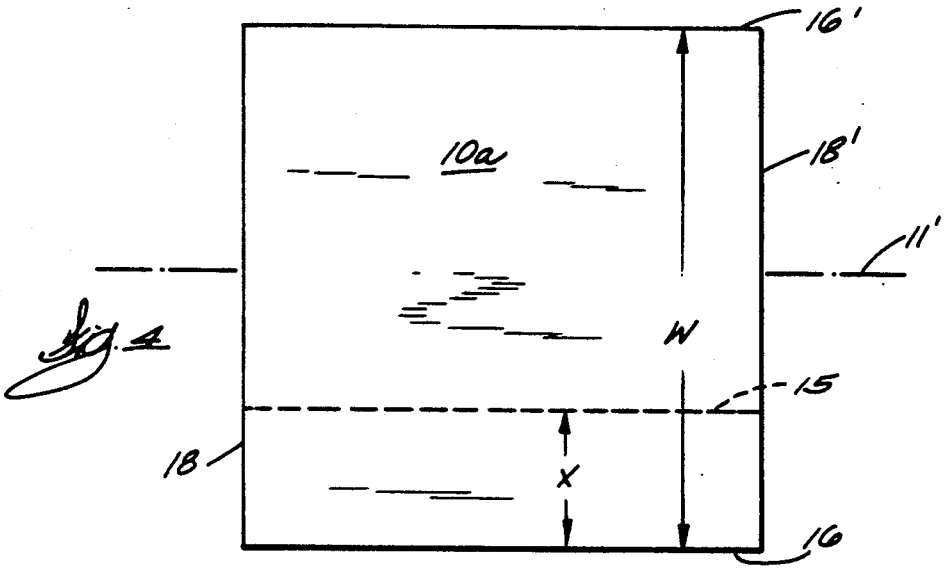

Sheet 10*a* shown in FIG. 4 has a pair of opposed parallel first edges 16, 16′ and a pair of opposed parallel second edges 18, 18′ that are perpendicular to first edges 16, 16′.

Figure 5:
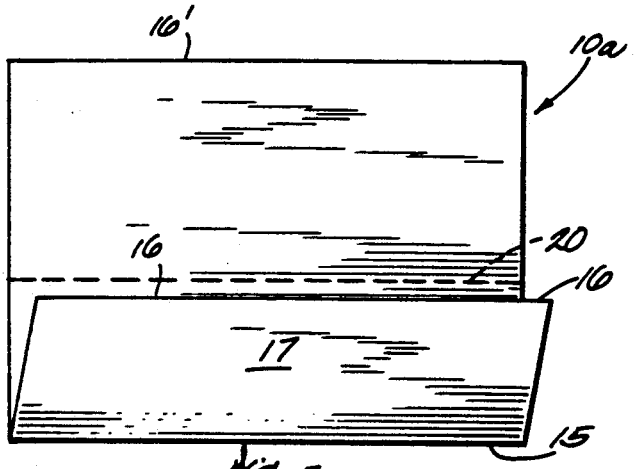
Figure 7:
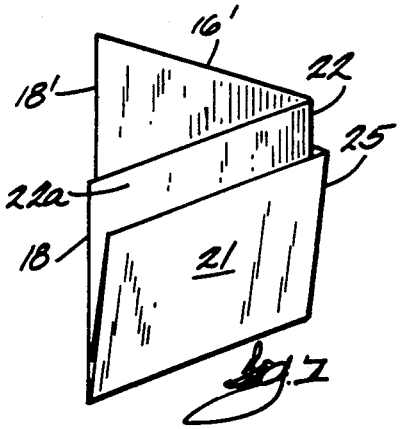
Figure 6:
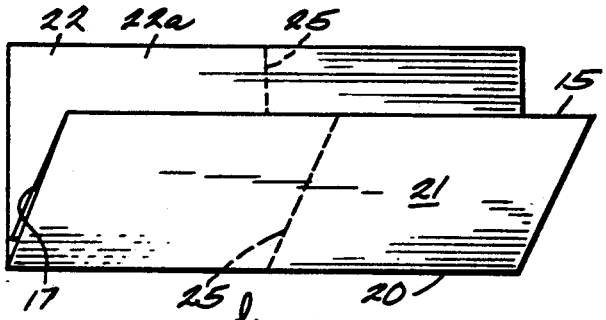
Figure 8:
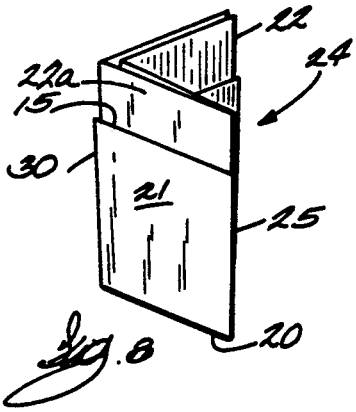

First fold 15 is formed in sheet 10*a* parallel to edge 16 thereof, located a distance X from edge 16 of about 5% to 30% of W. FIG. 5 illustrates the sheet after first fold 15 has been formed, and first panel 17 has been defined as the section of the sheet 10*a* between fold 15 and edge 16. Second fold 20 is formed next in the sheet, which is parallel to first fold 15 and spaced therefrom as shown in FIGS. 5 and 6, FIG. 6 illustrating the sheet after second fold 20 has been completed. FIG. 6 also illustrates the relationship between first panel 17, second panel 21 and third panel 22 defined after the first and second folds have been formed, each panel comprising a section of the sheet 10*a*. First perpendicular fold 25 is illustrated in FIG. 7, see also FIG. 6, and is formed by folding the sheet of FIG. 6 in half perpendicular to first fold 15 and second fold 20. FIG. 8 illustrates second perpendicular fold 30 that is formed parallel to first perpendicular fold 25 and also perpendicular to folds 15 and 20 and results in the final configuration of the folded napkin. Folds 25 and 30 are both parallel to edges 18, 18' of sheet 10*a*. In FIGS. 5–8, the napkin is illustrated with the various panels defined by the respective folds slightly separated from the balance of the structure for clarity of description, it being understood that the various panels lie flat against one another in actual production.

FIG. 9 illustrates folded napkin 24 in perspective and FIGS. 10–11 are sectional view of the folded napkin after the four folds described above in connection with FIGS. 1–3 and FIGS. 4–8 have been completed. A pocket 40 is formed in the folded napkin that has a two layer front wall consisting of a portion of second panel 21 along the exterior and an underlying portion of first panel 17 along the interior of the front wall and has a rear wall that is defined by four layers of folded third panel 22. Pocket 40 has a closed bottom portion defined by a section of second fold 20, a closed right hand side portion defined by a section of first perpendicular fold 25 and a closed left hand side portion defined by a section of second perpendicular fold 30. The pocket has an open top edge 41, defined by a section of first fold 15, through which utensils such as spoon 42, fork 43 and knife 44 can be inserted into the pocket. The utensils will be held securely in place since the pocket has closed bottom and side edge portions. Further, four layers of tissue are provided above the open top edge of the pocket for supporting and protecting the sections of the utensils extending out of the pocket, which layers are defined by a folded section 22*a* of third panel 22 that extends above top edge 41 of the pocket. Third panel 22 is longer than second panel 21 so as to provide section 22*a*, which serves to cover one side of exposed sections of the utensils for protection against contamination.

In FIG. 9, utensils 41–43 are shown as being inserted in pocket 40 with their eating surfaces inside the pocket. This arrangement provides the maximum protection against contamination of these portions of the utensils. An alternate arrangement is shown in FIG. 9*a* in which the handle sections of the utensils are inserted in pocket 40; this provides less protection against contamination of the eating surfaces of the utensils, but increases their visibility and may be a preferred arrangement in some cases.

FIGS. 12–17 illustrate sheet 10*a* folded according to a second embodiment of the present invention in which second fold 20 as shown in the first embodiment of FIGS. 1–11 is not utilized for this alternative construction. The same reference numerals used in the foregoing description with reference to FIGS. 1–11 are used in the following description to identify the same or similar elements.

First fold 15 is formed in sheet 10*a* parallel to edge 16 thereof and is located a distance X' from edge 16. Distance X' is in the range of from about 30% to 50% of W, preferably in the range of about ½W to about 1 inch less than ½W. FIG. 13 illustrates the sheet after fold 15 has been formed. First panel 17 is defined as the section of sheet 10*a* between fold 15 and edge 16. The balance of sheet 10*a*, i.e. between first fold 15 and edge 16', defines panel 22' which is analogous to third panel 22 of the first embodiment of FIGS. 1–11. First fold 15 is illustrated in dashed line in FIG. 12 to denote its positioning relative to longitudinal axis 11' of sheet 10*a*. Turning to FIG. 14, first perpendicular fold 25 is formed by folding the sheet in half perpendicular to first fold 15 and parallel to edges 18, 18'; first perpendicular fold 25 is shown in dashed line in FIG. 13 to illustrate its positioning. FIG. 14 illustrates sheet 10*a* after first perpendicular fold 25 has been completed. Next, turning now to FIG. 15, second perpendicular fold 30 is formed by folding the sheet of FIG. 14 in half perpendicular to first fold 15; second perpendicular fold 30 is parallel to first perpendicular fold 25. Perpendicular folds 25 and 30 are both parallel to edges 18, 18' of sheet 10*a*. Upon completion of second perpendicular fold 30, folded napkin 24' is formed which is illustrated in perspective in FIG. 16. Pocket 40 is formed in folded napkin 24' and has a single layer front wall consisting of a portion of first panel 17 and a seven layer rear wall defined by three sections of first panel 17 and four layers of folded panel 22'. Pocket 40 has a closed bottom portion defined by a section of first fold 15, a closed right hand side portion defined by a section of first perpendicular fold 25 and a closed left hand side portion defined by a section of second perpendicular fold 30. The pocket has an open top 41 defined by a section of edge 16, and utensils such as spoon 42, fork 43, and knife 44 are inserted through the open top into pocket 40. The advantage of this second embodiment is apparent from FIG. 16 in that pocket 40 is deep enough to fully enclose the utensils 42–44. The relatively deeper pocket of this second embodiment thus provides for complete coverage of the utensils while stored in the pocket. This is a result of forming first fold 15 equal to or nearly equal to ½ the width W of the sheet. The utensils can be inserted in the pocket with their eating surfaces along the bottom so that they can be withdrawn from the pocket without touching the eating surfaces; also, however, the utensils can be inserted in the pocket with the eating surfaces near the open top such as illustrated in FIG. 9*a*.

The folded napkin of the second embodiment also can be made starting with a web 10 of tissues as illustrated in FIG. 1. A single folding station is employed to form first fold 15 in the web that is parallel to a longitudinal edge 16 and parallel to the longitudinal axis 11 of the web. After first fold 15 is formed, individual napkins are cut from the folded web and then first and second perpendicular folds 25 and 30 are formed in a severed folded napkin.

FIGS. 18 and 19 illustrate a third embodiment of a folded napkin of the invention. A section of a web 10*b* of tissue is shown in FIG. 18 as made of two plies, ply 50 and ply 51. Each ply may consist of one or two layers, as desired. The plies are of two different colors, which is denoted in FIGS. 18 and 19 by the stippling of ply 50 and the lack of stippling of ply 51; the plies are shown partly separated in FIG. 18 to further clarify the construction of the web.

Web 10*b* is folded and formed into individual napkins as described previously with respect to web 10 and FIGS. 1–3 and 9–11, to thereby form folded napkin 24' illustrated in FIG. 19. (Also, however, napkin 24' can be folded as illustrated in FIGS. 12–17.) Folded napkin 24' includes a pocket 40 with a closed bottom defined by section of second fold 20, a closed right hand side portion defined by a section of first perpendicular fold 25 and a closed left-hand side portion defined by a section of second perpendicular fold 30. Utensils 42–44 are inserted into pocket 40 through its open top edge 41. The exterior of the front wall of pocket 40 consists of a portion of second panel 21; further, section 22*a* of third panel 22 extends above the top edge of the pocket under the exposed sections of utensils 42–44.

The described folds and spatial relationship of the several panels provides an appearance that is unique to folded napkin 24' by reason of its being formed from a web having two plies of two different colors. As best shown in FIG. 19, the section of second panel 21 that forms the exterior of pocket 40 is in the color of ply 51, and the section 22*a* of third panel 22 extending above the pocket is in the color of ply 50. Thus, the front surface of the pocket consists of part of ply 51 in its color and the front surface of section 22*a* of the third panel above the top edge of the pocket consists of part of ply 50 in its color which is different than the color of ply 51. This results in a highly attractive and distinctive appearance wherein two different colors are presented along the front surface of the napkin. This is a novel arrangement not heretofore taught by the prior art and provides an end user, such as a food service operation, with a wide range of possibilities for enhancing the visual impact of a set of folded napkins and enables the manufacturer to tailor the color combinations of the two plies to specific end users.

EXAMPLE 1

Folded paper napkins were made according to the process described above in connection with FIGS. 1–3 starting with a web of single ply tissue 17 inches wide. First fold 15 was formed in the web parallel to and about 3¼ inches from one longitudinal edge of the web. Second fold 20 was formed in the web a distance of about 5 inches from first fold 15. The folded web was then cut at intervals of 17 inches to provide square napkins 17 inches by 17 inches when in an unfolded condition. First perpendicular fold 25 was formed in the napkins by folding along a centerline perpendicular to the first and second folds, following which the napkin was folded in half again along second perpendicular fold 30 parallel to fold 25. The folded napkin had a pocket 40 that was 5 inches long and 4¼ inches wide, and about 3 inches of third panel 22 extended above the open top of the pocket. It was found that utensils can be inserted in the pocket and retained in place until such time as they were to be used. The napkin is readily unfolded for use in the normal fashion after the utensils are removed from the pocket. Also, it was found that forming the first and second folds while the tissue was in web form enables the manufacture of the folded napkin at minimum extra cost, so that it would be economically feasible to produce a folded napkin of the invention at a cost competitive with the usual style of napkin.

EXAMPLE 2

A folded napkin 24' of the style illustrated in FIGS. 12–17 was made starting with a rectangular paper napkin about 15"×17". First fold 15 was formed in the napkin parallel to one of its long edges and located about 6.8" from said edge. First perpendicular fold 25 was formed in the napkin by folding along a centerline perpendicular to first fold 15, following which second perpendicular fold 30 was formed by folding the resulting folded napkin perpendicular to first fold 15. The folded napkin 24' had a pocket 40 that was about 6.8" long and about 4.3" wide. The pocket was of a size sufficient to fully enclose plastic eating utensils that were as long as 6.5 inches.

There has thus been described folded napkin constructions providing a pocket for storing eating utensils until ready for use in which the pocket is of a construction capable of holding and protecting the utensils. The pocket is of a useful construction inasmuch as it is rectangular in shape, which facilitates insertion of utensils in the pocket, provides tissue surrounding the utensils, can accommodate the full length of utensils or allows storing the utensils in such fashion that any portion thereof extending above the open top edge of the pocket rests against a multiple layer panel of the napkin. Storing utensils in the pocket has another advantage in that the front of the pocket is visible and can be used for printed matter, such as designs, advertising, company logos, etc., since the utensils do not cover the front of the pocket as is the case when they are set on top of a napkin. A napkin of my invention can be folded from a single sheet of tissue of one to four plies cut to the desired size. Moreover, however, folded napkins of my invention can be made by continuously advancing a web of tissue and forming one or two folds while the tissue is in web form, and forming the remaining two folds after the folded web has been cut into individual napkins. Being able to carry out some of the folding steps with the tissue in web form is made possible by a folded napkin construction including one or two folds parallel to a longitudinal edge of the web and other folds perpendicular thereto.

The foregoing enabling description of the present invention is made in full and complete detail, but it is anticipated that those skilled in the art will be able to devise changes in the illustrated embodiments that will remain within the spirit and scope of this invention as set forth in the claims.

I claim:

1. In a paper napkin comprising a square or rectangular sheet having a pair of opposed parallel first edges and a pair of opposed parallel second edges perpendicular to the first edges, the sheet being folded to define a folded napkin having a pocket for holding utensils, the improvement wherein: the folded napkin includes:

(1) a first fold parallel to and spaced from one edge of the sheet, (2) a second fold parallel to the first fold, (3) a first panel defined between the first fold and said one edge, a second panel defined between the first fold and the second fold, and a third panel defined between the second fold and the edge of the sheet opposite from said one edge, the panels arranged with the first panel between the second and third panels, (4) a first perpendicular fold perpendicular to the first and second folds to position the second panel exterior of the third panel, and (5) a second perpendicular fold parallel to the first perpendicular fold; the folded napkin having a pocket including (6) a closed bottom portion defined by a section of the second fold, (7) opposed closed side portions defined by the first and second perpendicular folds, and (8) an open top portion defined by the first fold, and (9) a front surface comprising a portion of the second panel;

a portion of the third panel extends beyond the open top portion of the pocket; and the sheet includes first and second plies that have different colors, and the front surface of the pocket consists of part of the first ply and the front surface of the portion of the third panel extending beyond the open top portion of the pocket consists of part of the second ply.

2. A folded napkin according to claim 1, wherein:

the first fold is spaced from one first edge of the sheet about 5% to 30% of the distance between said one first edge and the opposite first edge of the sheet, and the second fold is spaced about ¼ to 6 inches from said one first edge of the sheet.

3. A folded napkin according to claim 2, wherein:

the first perpendicular fold is formed along the center of the first, second and third panels, and the second edges of the sheet are superposed on one another.

4. A folded napkin according to claim 3, wherein:

the second perpendicular fold is formed centrally between the first perpendicular fold and the superposed second edges.

* * * * *